US010763593B1

(12) United States Patent
Wrigley

(10) Patent No.: US 10,763,593 B1
(45) Date of Patent: Sep. 1, 2020

(54) BROADBAND SINGLE POL TX, DUAL POL RX, CIRCULAR POLARIZATION WAVEGUIDE NETWORK

(71) Applicant: Lockheed Martin Corporation, Bethesda, MD (US)

(72) Inventor: Jason Stewart Wrigley, Broomfield, CO (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 31 days.

(21) Appl. No.: 16/263,639

(22) Filed: Jan. 31, 2019

Related U.S. Application Data

(60) Provisional application No. 62/757,087, filed on Nov. 7, 2018.

(51) Int. Cl.
*H01Q 21/24* (2006.01)
*H01P 1/18* (2006.01)
*H01Q 15/24* (2006.01)

(52) U.S. Cl.
CPC ..... *H01Q 21/245* (2013.01); *H01P 1/182* (2013.01); *H01Q 15/242* (2013.01)

(58) Field of Classification Search
None
See application file for complete search history.

(56) References Cited

U.S. PATENT DOCUMENTS 6,661,309 B2 * 12/2003 Chen ..... H01P 1/2131 333/126
7,408,427 B1 * 8/2008 Lee-Yow ..... H01P 1/161 333/126
2010/0149058 A1 * 6/2010 Bosshard ..... H01P 1/2131 343/756
2011/0181479 A1 * 7/2011 Martin ..... H01Q 25/02 343/756
2018/0233829 A1 * 8/2018 Wrigley ..... H01Q 13/0258

* cited by examiner

*Primary Examiner* — Minh D A
*Assistant Examiner* — James H Cho
(74) *Attorney, Agent, or Firm* — Morgan, Lewis & Bockius LLP

(57) ABSTRACT

A polarization waveguide network includes a reactive transmit (TX) power splitter and multiple receive (RX)-reject waveguide filters to reject RX frequencies. The polarization waveguide network further includes a quadrature junction coupler that can couple the RX-reject waveguide filters to an antenna port. The polarization waveguide network is configured to be fabricated in three pieces with two zero-current split planes, and a first piece of the three pieces is used for coupling to the antenna port.

20 Claims, 15 Drawing Sheets

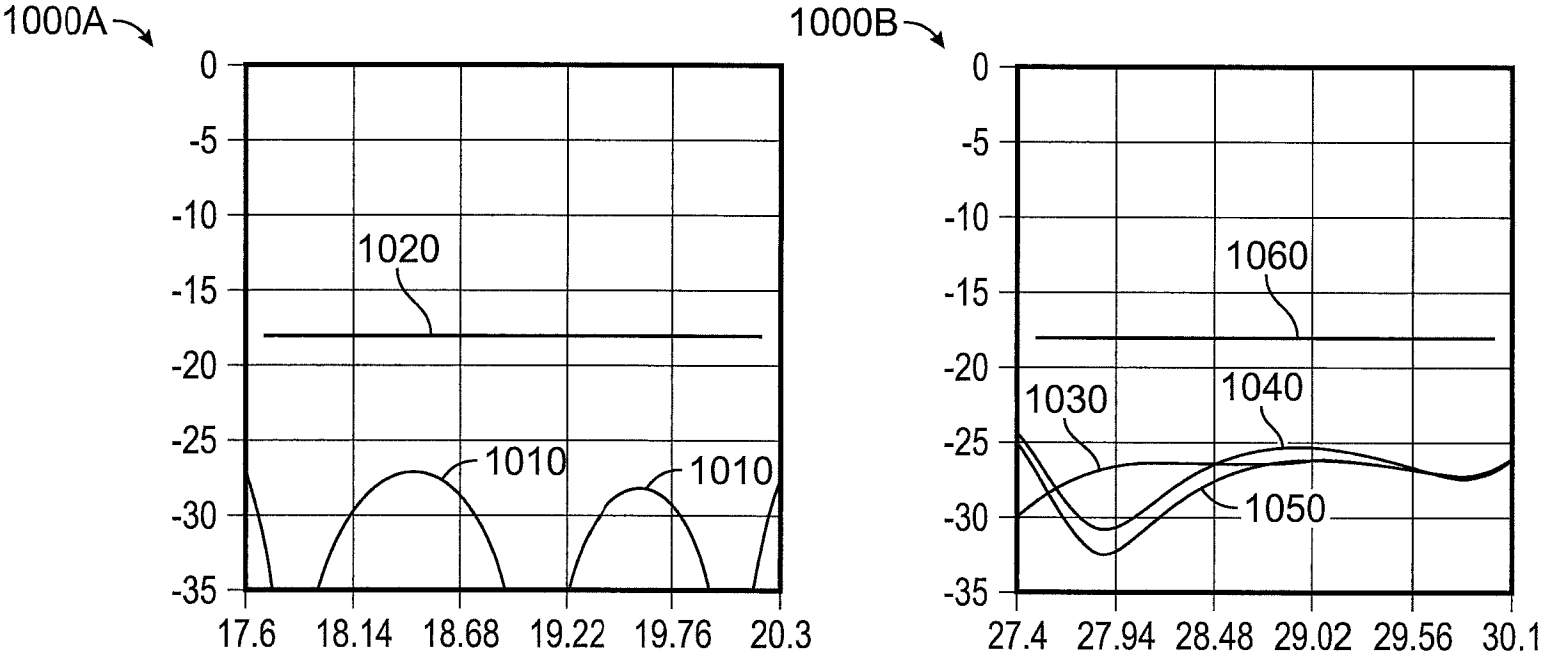
FIG. 10A
FIG. 10B
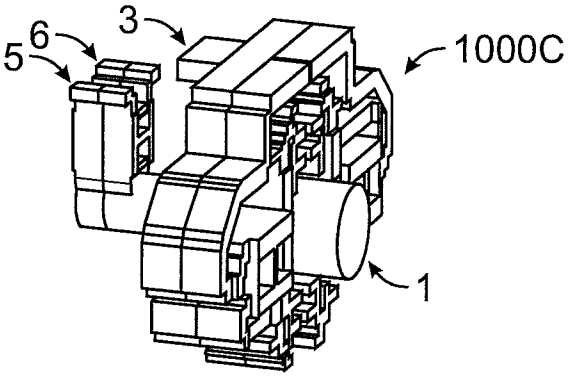
FIG. 10C

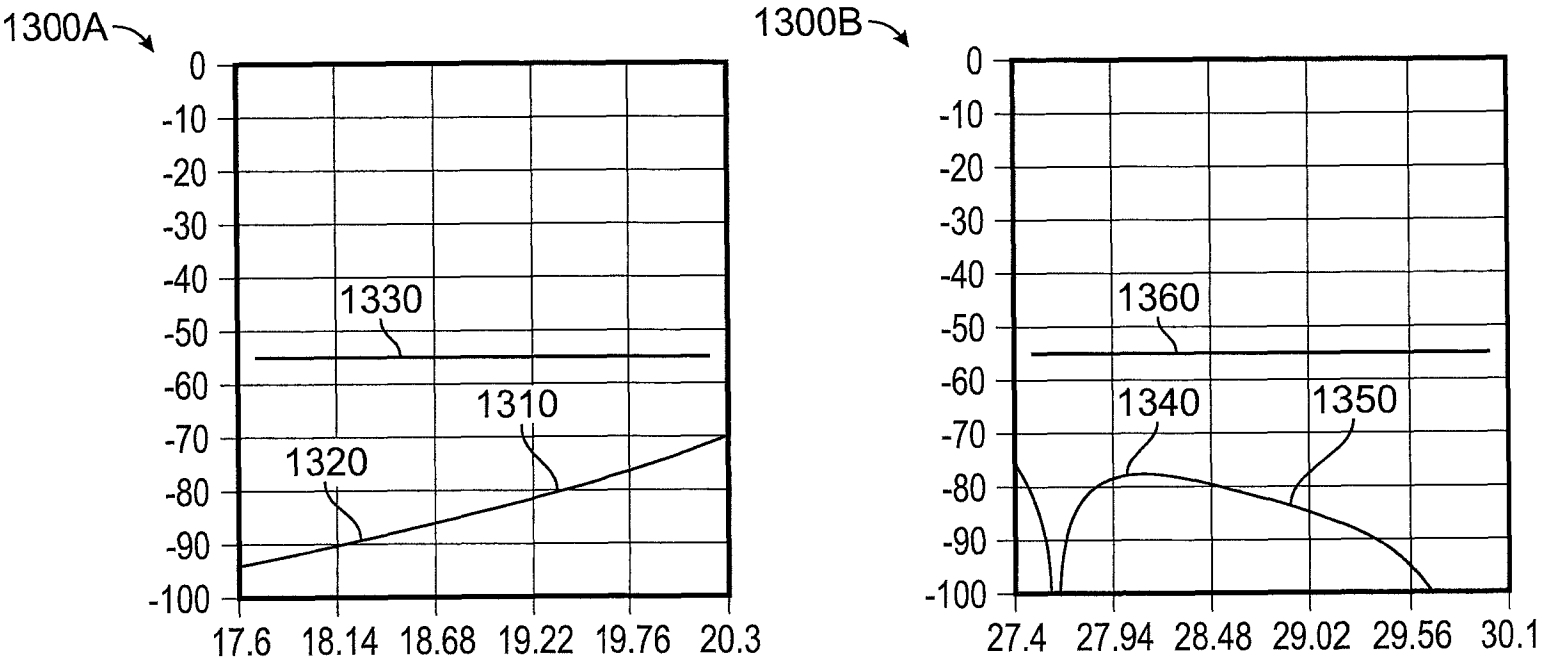
FIG. 13A
FIG. 13B
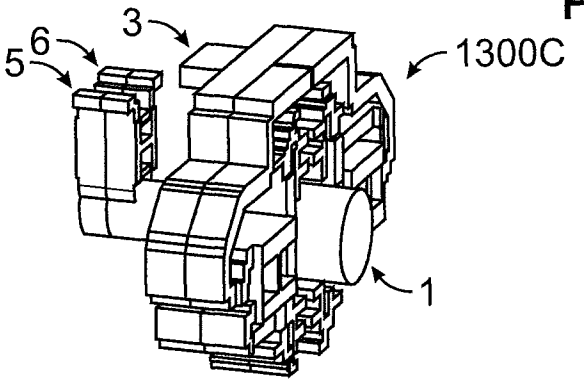
FIG. 13C

BROADBAND SINGLE POL TX, DUAL POL RX, CIRCULAR POLARIZATION WAVEGUIDE NETWORK

CROSS-REFERENCE TO RELATED APPLICATIONS

This application claims the benefit of priority under 35 U.S.C. § 119 from U.S. Provisional Patent Application 62/757,087 filed Nov. 7, 2018, which is incorporated herein by reference in its entirety.

STATEMENT REGARDING FEDERALLY SPONSORED RESEARCH OR DEVELOPMENT

Not applicable.

FILED OF THE INVENTION

The present invention generally relates to antenna technology, and more particularly to a broadband single-polarization transmit (TX), dual-polarization receive (RX), circular polarization waveguide network.

BACKGROUND

Many space and terrestrial communication systems can communicate over a radio frequency (RF) link such as Ku-band, Ka-band or other suitable type of link. The Ku-band and the Ka-band, for example, are portions of the electromagnetic spectrum in the microwave range of frequencies between 10 GHz and 18 GHz, and 17 GHz and 40 GHz, respectively. Existing Ka-band circular polarization (CP) waveguide networks are generally rather complex and quite expensive to produce and may require a large network size. For example, an existing solution generates broadband CP by using two septum polarizers, one for (receive) RX and one for transmit (TX), that feed to a double quadrature junction (QJ) network coupled to receive-reject filters and transmit-reject filters. This solution may be impossible to fabricate as a simple split block with minimal split planes due to complexity of the employed QJs, RX filters, TX filters and septum polarizers.

SUMMARY

According to various aspects of the subject technology, methods and configuration are disclosed for providing low-cost and compact Ka-band circular polarization waveguides with single polarization transmit (TX) and dual or single polarization receive (RX).

In one or more aspects, a polarization waveguide network includes a reactive power splitter and multiple RX-reject waveguide filters to reject RX frequencies. The polarization waveguide network further includes a quadrature junction coupler that can couple the RX-reject waveguide filters to an antenna port. The polarization waveguide network is configured to be fabricated in just three pieces, with two zero-current split planes and a first piece of three pieces which couples to the antenna port.

In other aspects, an antenna array system includes an antenna array consisting of a number of antenna elements and a polarization array implemented using multiple polarization waveguide networks. Each polarization waveguide network is coupled to an antenna port of the antenna elements and includes a reactive TX power splitter and number of RX-reject waveguide filters to reject RX frequencies. Each polarization waveguide network further includes a pair of branch-line couplers to couple the RX-reject waveguide filters to the reactive TX power splitter, and a quadrature junction coupler that couples the RX-reject waveguide filters to an antenna port of the antenna element. Each waveguide network of the polarization array can be fabricated in three pieces with two zero-current split planes, and the first of the three pieces can be coupled to the antenna port.

In yet other aspects, a method of manufacturing a polarization waveguide network includes fabricating a first piece comprising air cavities including a reactive TX power splitter, a number of RX-reject waveguide filters, a pair of branch-line couplers to couple the plurality of RX-reject waveguide filters to the reactive TX power splitter and a quadrature junction coupler (QIC) for coupling the RX-reject waveguide filters to an antenna port. The method further includes fabricating a second piece comprising air cavities including a circular waveguide comprising a first portion for coupling to the antenna port and a second portion for coupling to an RX port, and fabricating a third piece comprising air cavities including an RX network supporting right-handed circular polarization (RHCP) and left-handed circular polarization (LHCP) modes and also including a TX-reject waveguide filter, an RX branch-line coupler, a circular waveguide and two RX ports.

The foregoing has outlined rather broadly the features of the present disclosure so that the following detailed description can be better understood. Additional features and advantages of the disclosure, which form the subject of the claims, will be described hereinafter.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein:

FIGS. 10A, 10B and 10C are charts illustrating return-loss performance as well as RHCP to LHCP isolation in RX of an example broadband polarization waveguide network and a corresponding air-cavity model, according to certain aspects of the disclosure.

FIGS. 13A, 13B and 13C are charts illustrating transmit (TX)-receive (RX) isolation performance of an example broadband polarization waveguide network and a corresponding air-cavity model, according to certain aspects of the disclosure.

DETAILED DESCRIPTION

Figure 1:
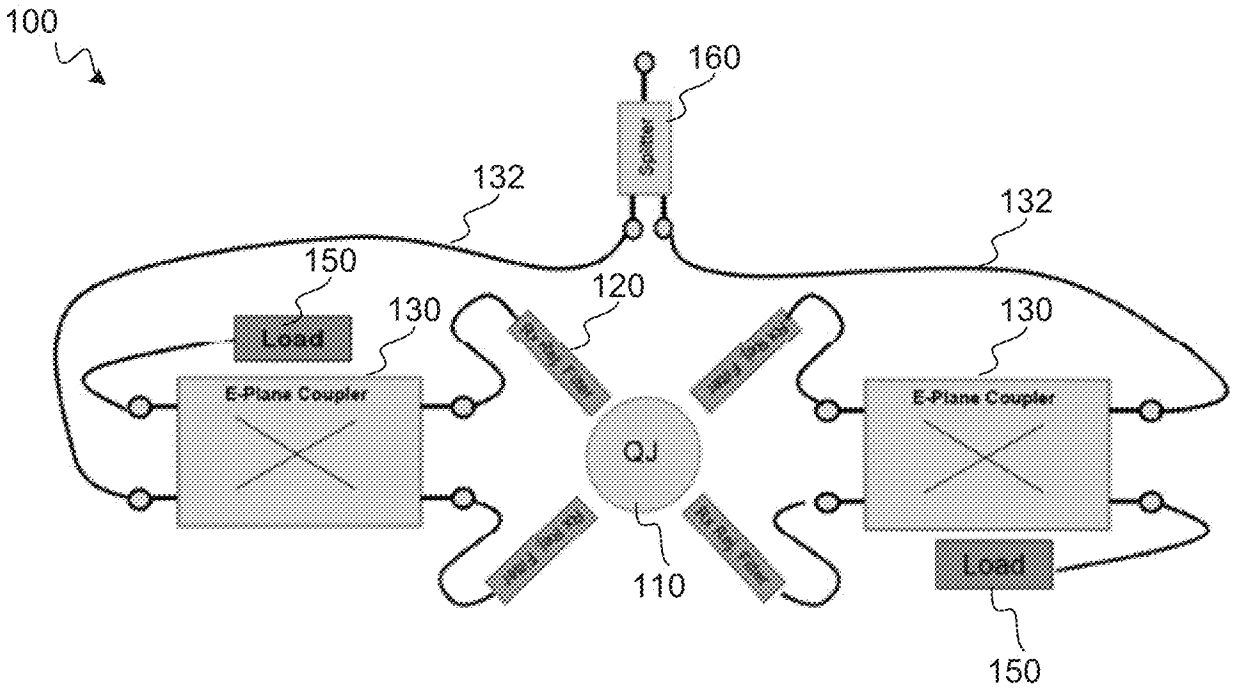
FIG. 1 is a conceptual diagram illustrating an example of the TX portion of a broadband polarization waveguide network, according to certain aspects of the disclosure.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block-diagram form in order to avoid obscuring the concepts of the subject technology.

Methods and configurations are described for providing a low-cost and compact Ka-band circular polarization waveguides. In particular, the subject technology relates to microwave circular polarization waveguides with single polarization transmit (TX) and dual or single polarization receive (RX) in the Ka-band (e.g., 17.70 to 20.20 GHz and 27.50 to 30.00 GHz) of the electromagnetic spectrum. In some implementations, the circular polarization waveguide of the subject technology can be a simple waveguide with three pieces of direct machined aluminum with split planes mostly on the zero-current line. The feed can be desirably fit under the smallest aperture sizes for array configurations.

In some implementations, by utilizing two E-plane couplers rather than just one, the subject technology allows completing the entire transmit portion, for example, right-handed circular polarization (RHCP) or left-handed circular polarization (LHCP) single polarization operation in just one split plane. In some implementations, there is no need to jump the waveguides over one another as is the case in the traditional approach which utilizes only one branch-line coupler. In one or more implementations, the disclosed RX network can be a dual LHCP and/or RHCP RX network. Existing solutions are typically at a much higher level of complexity (e.g., multipart multi-component assembly). The circular polarization (CP) is typically generated using just one E-plane coupler and the waveguides are then routed to the common waveguide pipes, using a symmetric network, which hop over each other (e.g., with many split planes). The disclosed waveguide can be made of three pieces of direct machined material (e.g., aluminum) at a cost of only a fraction (e.g., about 10%) of the cost of the traditional approach. Furthermore, the CP waveguide of the subject technology can be assembled and tested in a schedule which is greatly accelerated and with no tuning.

For the purposes of the present disclosure TX is the lower operating band and RX is the higher operating band. However, the TX and RX nomenclature here could be reversed as would be typical of a ground antenna rather than a space antenna.

FIG. 1 is a conceptual diagram illustrating an example of a broadband polarization waveguide network 100, according to certain aspects of the disclosure. Broadband polarization waveguide network 100 (hereinafter, "polarizer 100") includes a quadrature junction coupler (QJC) 110, four RX-reject waveguide filters 120, a pair of branch-line couplers (also referred to as "E-plane couplers") 130, and a TX power splitter 160. QJC 110 can be a circular waveguide that couples RX-reject waveguide filters 120 to an antenna (e.g., horn antenna) port. Branch-line couplers 130 are coupled to the TX power splitter 160 via TX recombination-path waveguides 132. The use of two branch-line couplers 130 by the subject technology overcomes the manufacturing hurdles facing the existing solution and allows fabrication of polarizer 100 in three pieces with two zero-current split planes. Polarizer 100 of the subject technology can be fabricated using a suitable material such as aluminum or other material, for example, by machining, electroplating, three-dimensional (3-D) printing or other fabrication techniques.

Figure 2B:
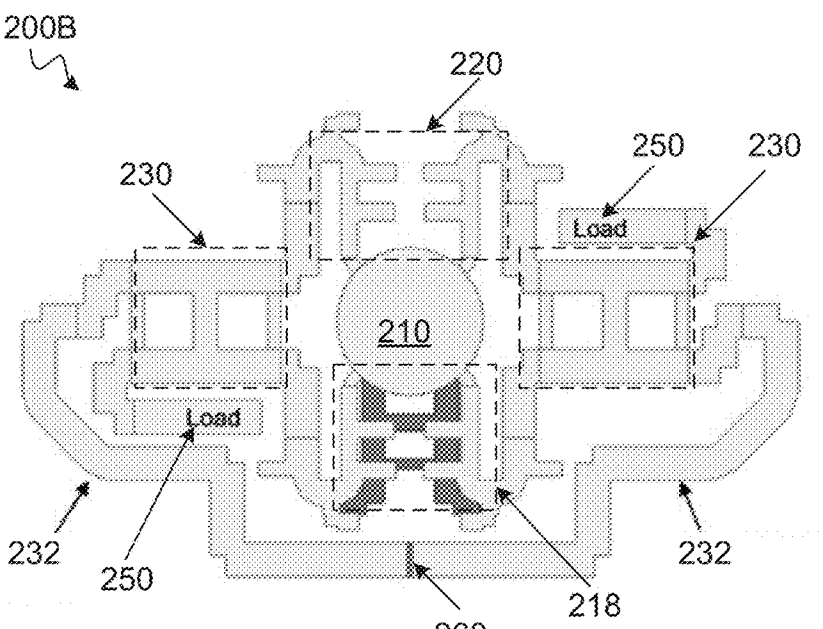
FIGS. 2A, 2B, 2C, 2D, 2E and 2F are diagrams illustrating various views of air-cavity models of an example broadband polarization waveguide network, according to certain aspects of the disclosure.
Figure 2A:
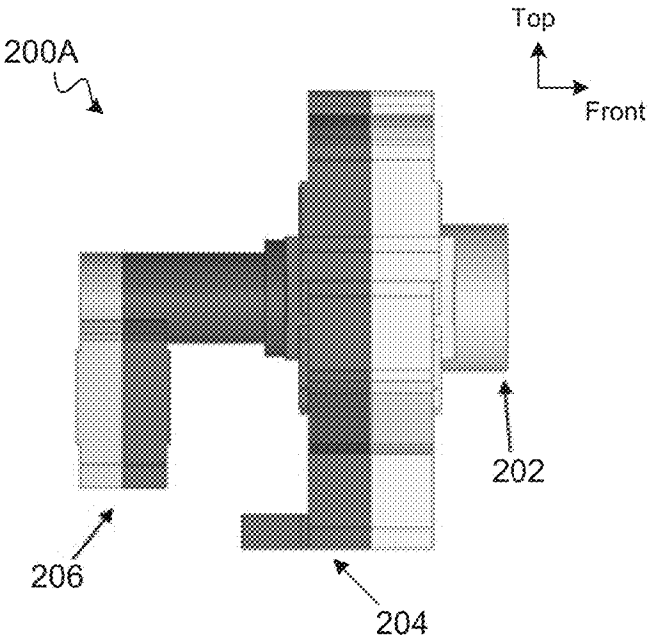

FIGS. 2A, 2B, 2C, 2D, 2E and 2F are diagrams illustrating various views of air-cavity models of an example broadband polarization waveguide network, according to certain aspects of the disclosure. FIG. 2A is perspective view of an air-cavity model 200A of the example broadband polarization waveguide network (e.g., polarizer 100 of FIG. 1). Air-cavity model 200A includes three pieces, a first piece 202, a second piece 204 and a third piece 206, which are joined together to collectively perform the functionalities of polarizer 100. Further details of air cavity model 200A is provided with respect to various polarizer components herein.

FIG. 2B shows a front-view 200B of air-cavity model 200A. The top-view 200B shows a QJC 210, four RX-reject waveguide filters 220, a pair of branch-line couplers 230, and a TX power splitter 260. QJC 210 is a circular waveguide and couples RX-reject waveguide filters 220 to an antenna (e.g., horn antenna) port. Branch-line couplers 230 are coupled to the TX power splitter 260 via a pair of TX recombination-path waveguides 232. The pair of TX recombination-path waveguides 232 are similar (e.g., substantially identical) in phase length and are structurally mirror images of each other. RX-reject waveguide filters 220 are configured to reject RX frequencies (e.g., within a range of about 27-30 GHz). Each of branch-line couplers 230 has four ports, two input ports and two output ports. The two output ports are coupled to RX-reject waveguide filters 220. One of the two input ports is coupled to one of the pair of TX recombination-path waveguides 232 and the other one is coupled to an impedance matching load 250.

Figure 2F:
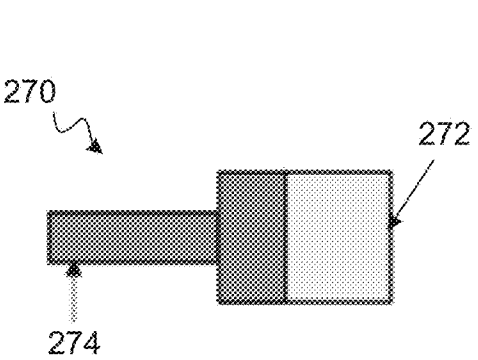
Figure 2E:
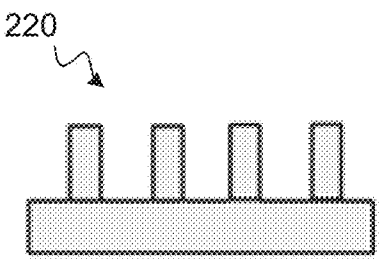
Figure 2D:
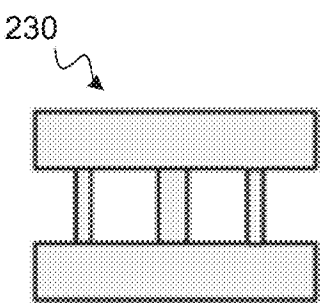
Figure 2C:
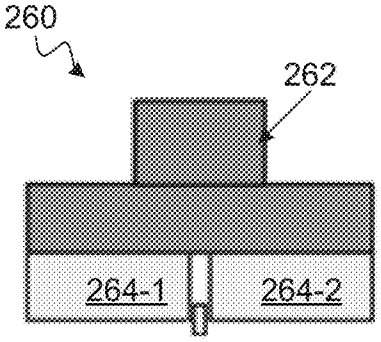

FIG. 2C shows a top view of TX power splitter 260. TX power splitter 260 includes an input waveguide 262 that divides an input power to two output waveguides 264-1 and 264-2, which are coupled to TX recombination-path waveguides 232.

FIG. 2D shows a front view of branch-line coupler 230. In some implementations, branch-line coupler 230 can have three or more branches.

FIG. 2E shows a front view of RX-reject waveguide filter 220. In some implementations, RX-reject waveguide filter 220 is a single-sided structure with three or more branches (teeth).

FIG. 2F shows a top view of TX-reject waveguide filter 270, which is implemented in third piece 206, as will be discussed in more detail herein. In some implementations, TX-reject waveguide filter 270 has a first circular waveguide 272 that supports both RX and TX modes of propagation and a second circular waveguide 274 that has a cutoff over the TX frequencies (e.g., within a range of about 17-20 GHz).

Figure 3B:
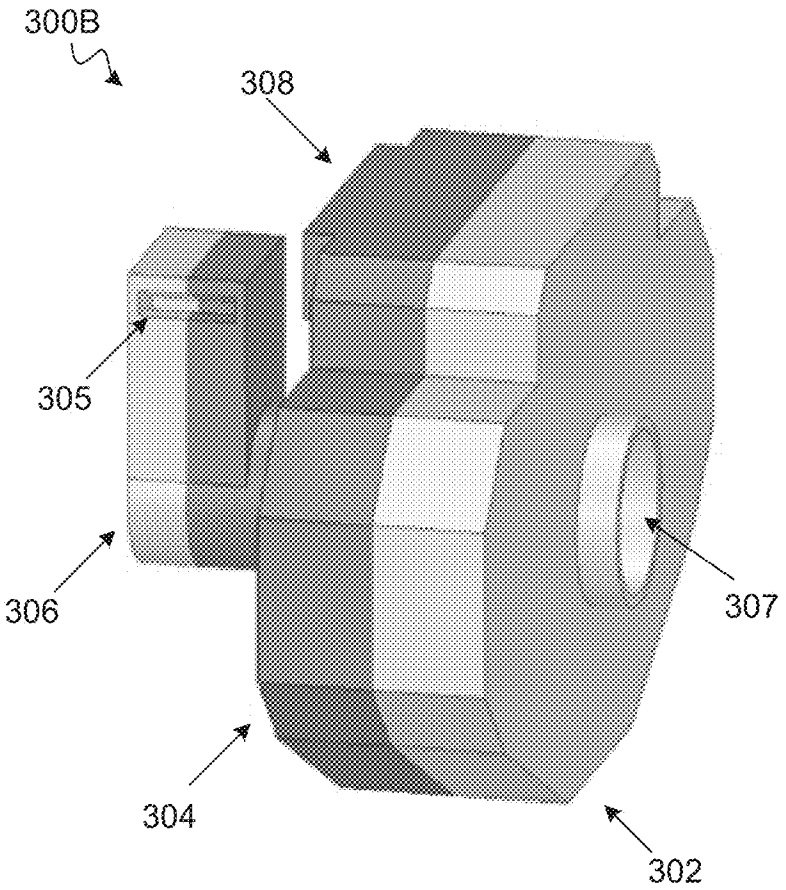
FIGS. 3A, 3B, 3C, 3D and 3E are schematic diagrams illustrating various views of air-cavity models and a shelled mode of an example broadband polarization waveguide network, according to certain aspects of the disclosure.
Figure 3A:
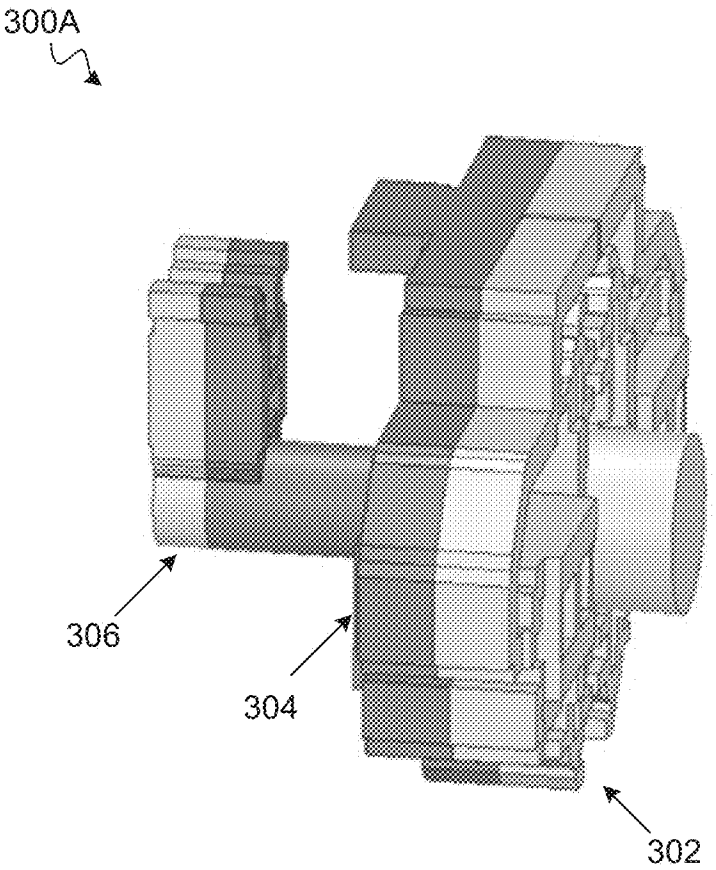
Figure 3E:
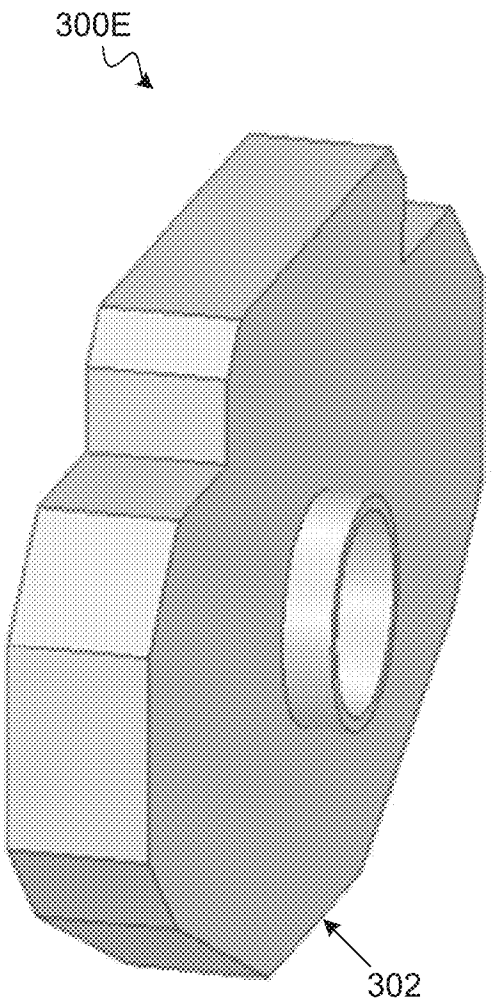
Figure 3D:
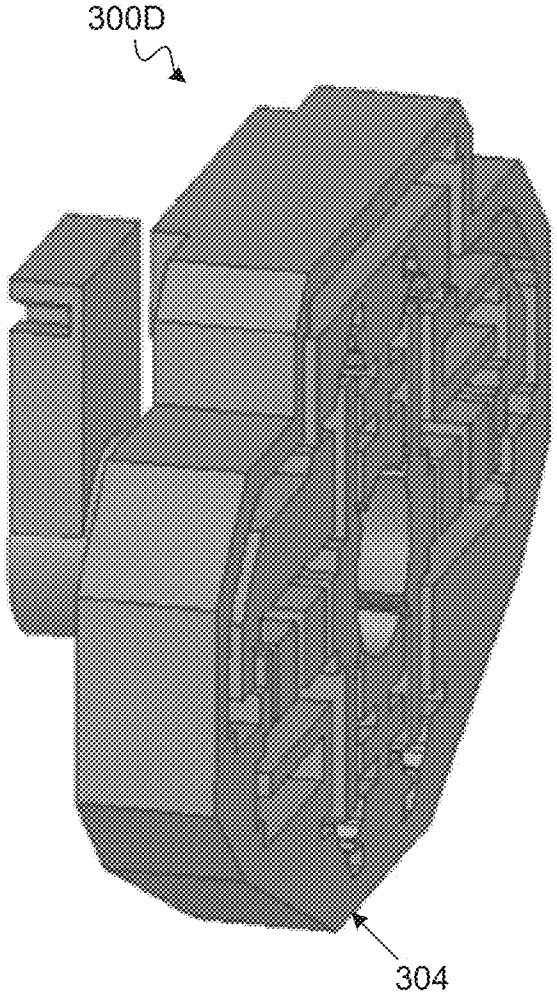
Figure 3C:
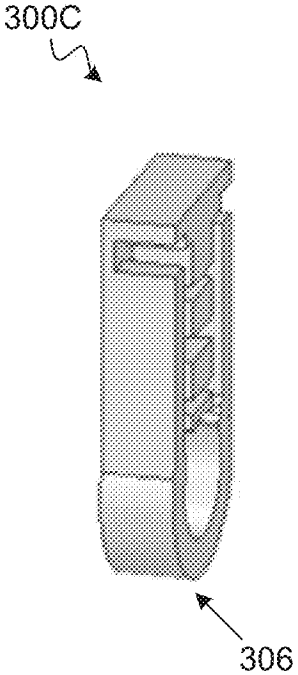

FIGS. 3A, 3B, 3C, 3D and 3E are schematic diagrams illustrating various views of air-cavity models and shelled models of an example broadband polarization waveguide network, according to certain aspects of the disclosure. FIG. 3A is a perspective view of an air-cavity model 300A of polarizer 100 of FIG. 1 and is similar to air-cavity model 200A of FIG. 2A. Air-cavity model 300A includes a first piece 302, a second piece 304 and a third piece 306. First piece 302, as described above, includes a QJC, four RX-reject waveguide filters, a pair of branch-line couplers, and a TX power splitter. More structural detail of second piece 304 and third piece 306 will be discussed below. FIG. 3B shows a perspective view of a shelled model 300B of polarizer 100. The shelled model is a fabrication model and shows an RX port 305, a TX port 308 and an antenna port 307 that can be coupled to a radio-frequency (RF) antenna. FIG. 3C shows a front view of third piece 306 of shelled model (fabrication model) 300B. FIG. 3D shows a front view of second piece 304 of shelled model 300B, and FIG. 3E depicts a front view of first piece 302 of shelled model 300B.

Figure 4:
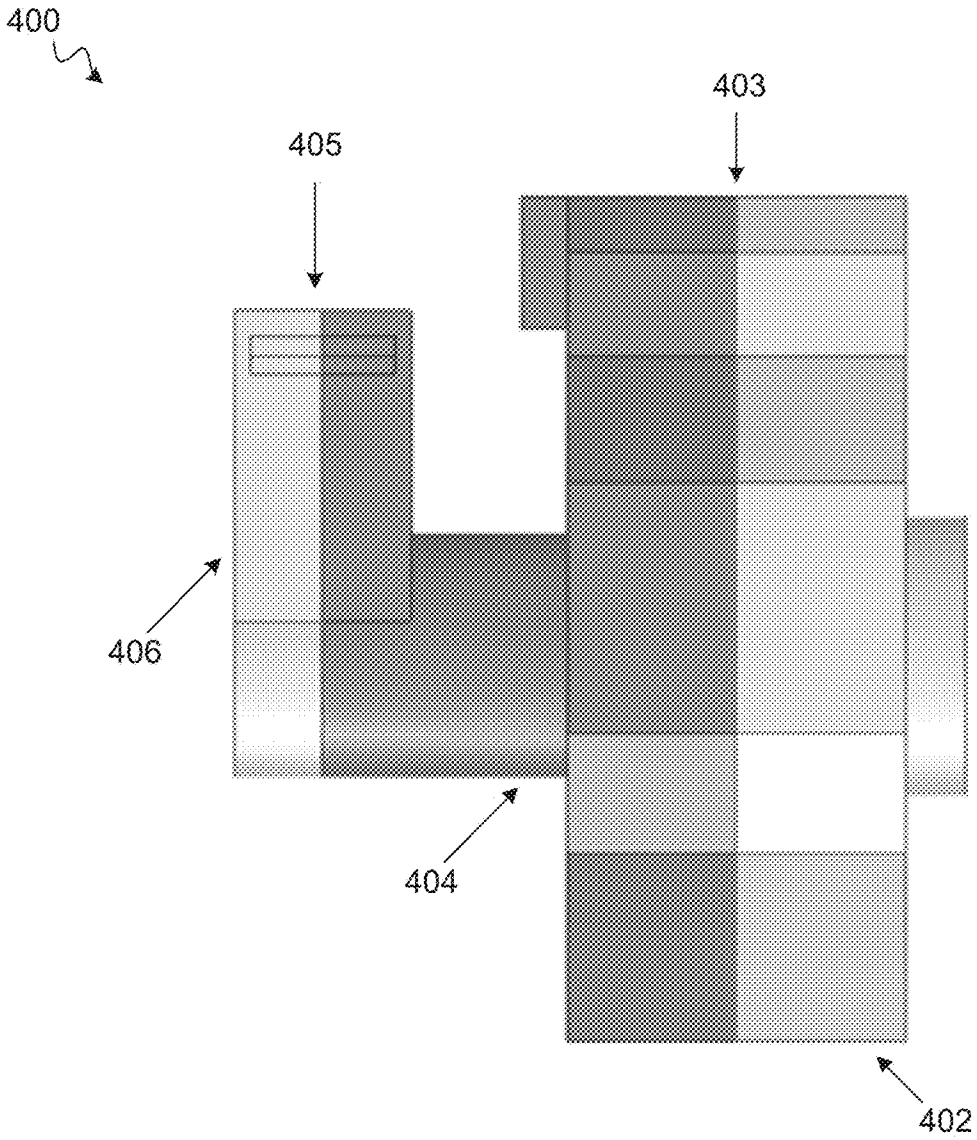
FIG. 4 is a schematic diagram illustrating a shelled model with split planes of an example broadband polarization waveguide network, according to certain aspects of the disclosure.

FIG. 4 is a schematic diagram illustrating a shelled model 400 with split planes of an example broadband polarization waveguide network, according to certain aspects of the disclosure. In shelled model 400, three pieces 402, 404 and 406 are the same as first piece 302, second piece 304 and third piece 306 of FIG. 3A. Three pieces 402, 404 and 406 are joined at two split planes 403 and 405, which are low-risk, zero-current planes that reduce the necessity of perfect contacts, resulting in more fabrication error tolerance.

Figures 5A, 5B:
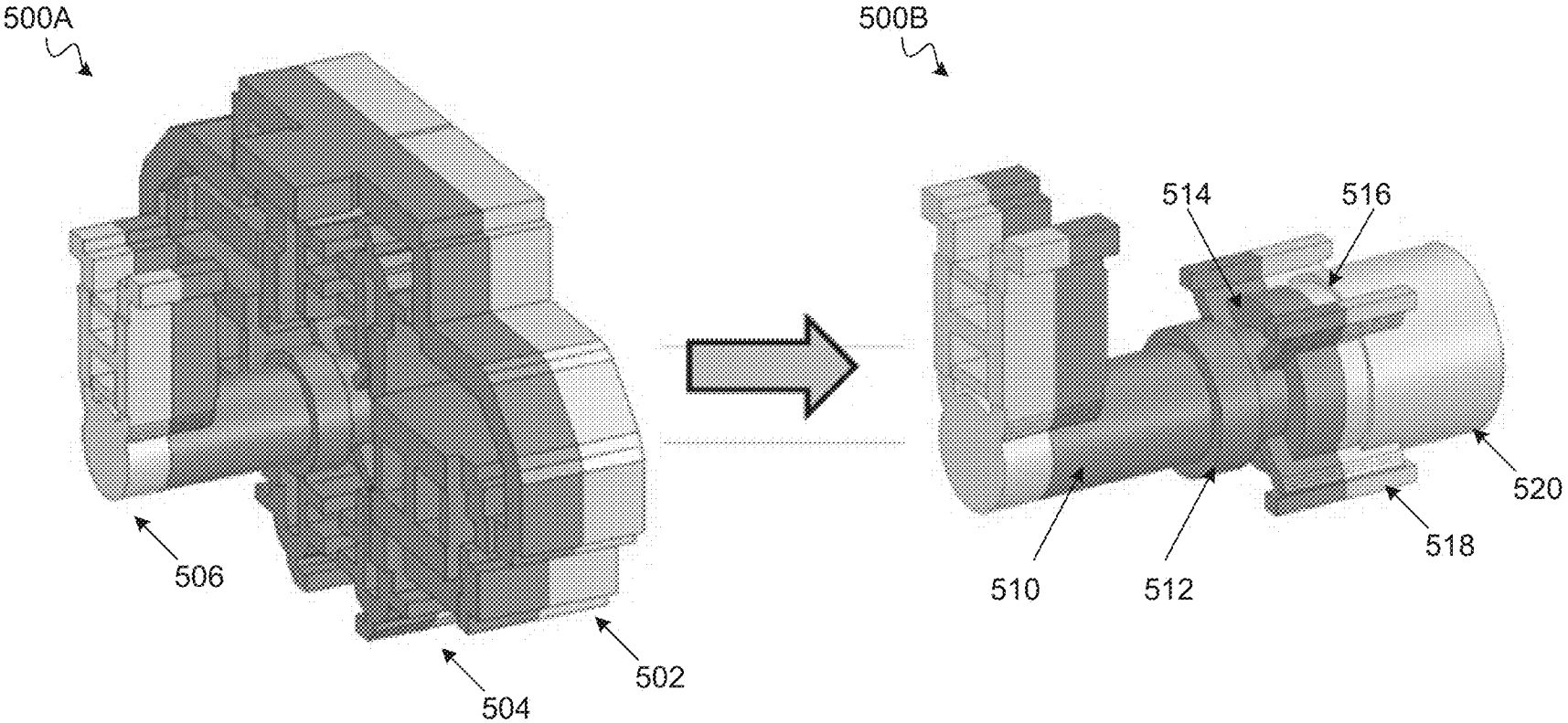
FIGS. 5A and 5B are schematic diagrams illustrating views of air-cavity models of an example broadband polarization waveguide network before and after removal of the transmit (TX) network, according to certain aspects of the disclosure.

FIGS. 5A and 5B are schematic diagrams illustrating views of air-cavity models 500A and 500B of an example broadband polarization waveguide network before and after removal of the TX network, according to certain aspects of the disclosure. FIG. 5A shows a perspective view of the air-cavity model 500A, which is similar to the air-cavity model 300A of FIG. 3A and includes a piece 502, a second piece 504 and a third piece 506. The perspective view shown in FIG. 5A is from a different angle from the one shown in FIG. 3A to revel the structure of the air-cavity implemented in second piece 504, which includes waveguides described with respect to FIG. 2B.

FIG. 5B shows a perspective view of air-cavity model 500B of polarizer shown in FIG. 5A, after removal of the TX network included in first piece 502 and second piece 504. Air-cavity model 500B includes a waveguide 510, an impedance matching ring 512, a major step 514, an impedance matching step 516, a transition region 518 and an antenna port 520. Waveguide 510 is coupled to a TX-reject filter in third piece 506 and allows for free propagation of RX signals, in particular in the TE11 dominant mode. Major step 514 is a step in the TX cutoff and is the beginning part of the TX-reject filter. Transition region 518 is the region where the RX-reject waveguide filters mate up.

Figure 6A:
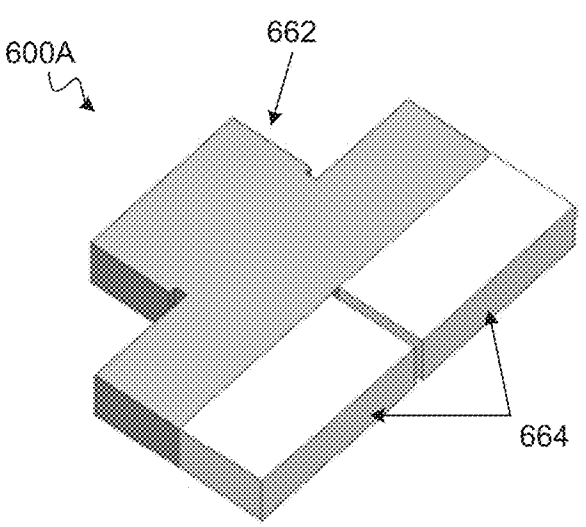
FIGS. 6A, 6B, 6C, and 6D are schematic diagrams illustrating air-cavity models of various components of an example broadband polarization waveguide network, according to certain aspects of the disclosure.

FIGS. 6A, 6B, 6C, and 6D are schematic diagrams illustrating air-cavity models of various components of an example broadband polarization waveguide network, according to certain aspects of the disclosure. FIG. 6A shows a perspective air-cavity model 600A of TX power splitter 260 of FIGS. 2B and 2C discussed above. A waveguide 662 is the input waveguide where the full TX power is received and delivered to two output waveguides 664 each receives a 3 dB portion of the input power and hands it to a TX recombination-path waveguide for input to a branch-line coupler at a phase equal to zero.

Figure 6B:
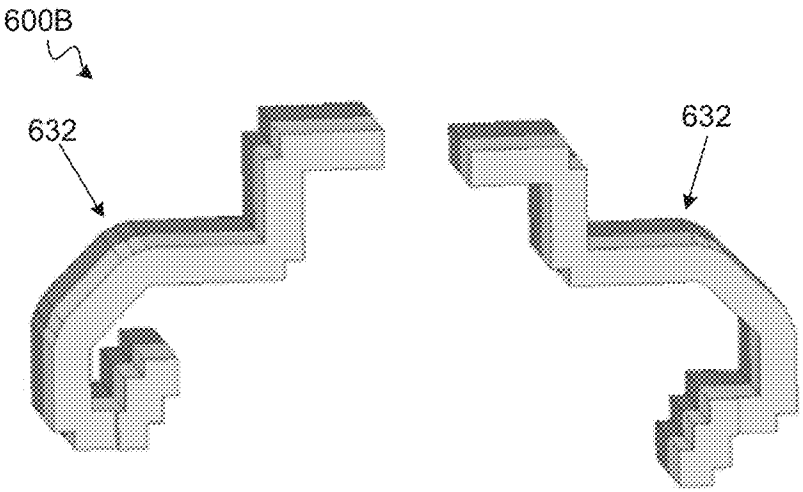

FIG. 6B shows a perspective air-cavity model 600B of TX recombination-path waveguides 632, which are 3-D models of TX recombination-path waveguides 232 of FIG. 2B. TX recombination-path waveguides 632 have similar steps but their end portions clock differently.

Figure 6C:
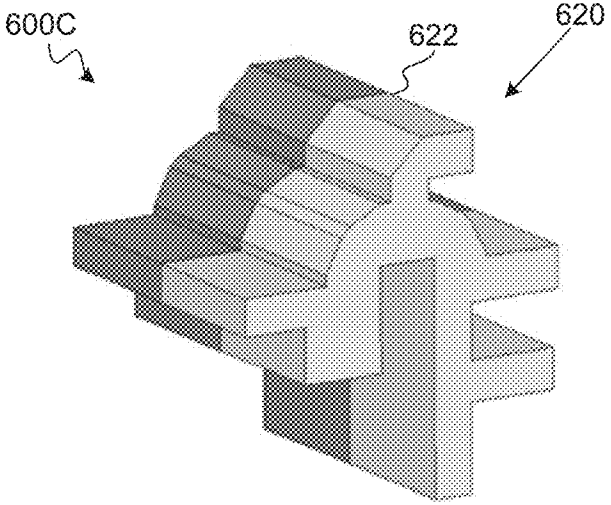

FIG. 6C depicts a perspective air-cavity model 600C of an RX-reject waveguide filter 620, which is a 3-D model of one of RX-reject waveguide filters 220 of FIG. 2B. The RX-reject waveguide filter 620 is a single-sided corrugated low-pass waveguide filter. Corrugation 622 is implemented on one side (top) of the waveguide only (rather than on two sides) to make the geometry more readily foldable. The corrugation 622 is folded over to create some room for the TX power splitter. The corrugations create a low-pass response which rejects the higher Rx frequencies.

Figure 6D:
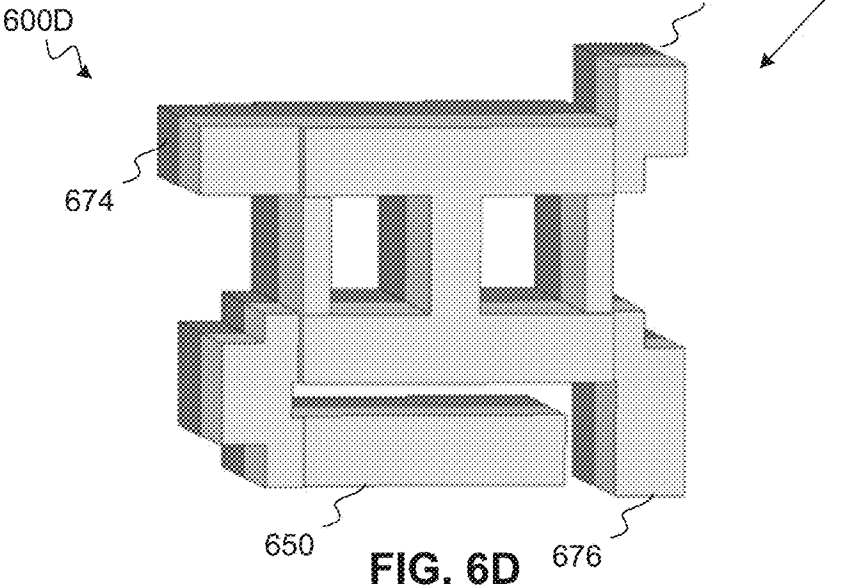

FIG. 6D illustrates a perspective air-cavity model 600D of a branch-line coupler 630, which is a 3-D model of branch-line coupler 230 of FIG. 2B. Air-cavity model 600D shows impedance matching load 650 and ports 672, 674 and 676. Port 672 is a 6-dB port with a phase of zero degrees and couples to the RX-reject waveguide filters and the QJC (e.g., 210 of FIG. 2B). Port 674 is a 3-dB port for coupling to TX recombination-path waveguides 632. Port 676 is a 6-dB port with phase of 90 degrees for coupling to the RX-reject waveguide filters and the QJC.

Figure 7B:
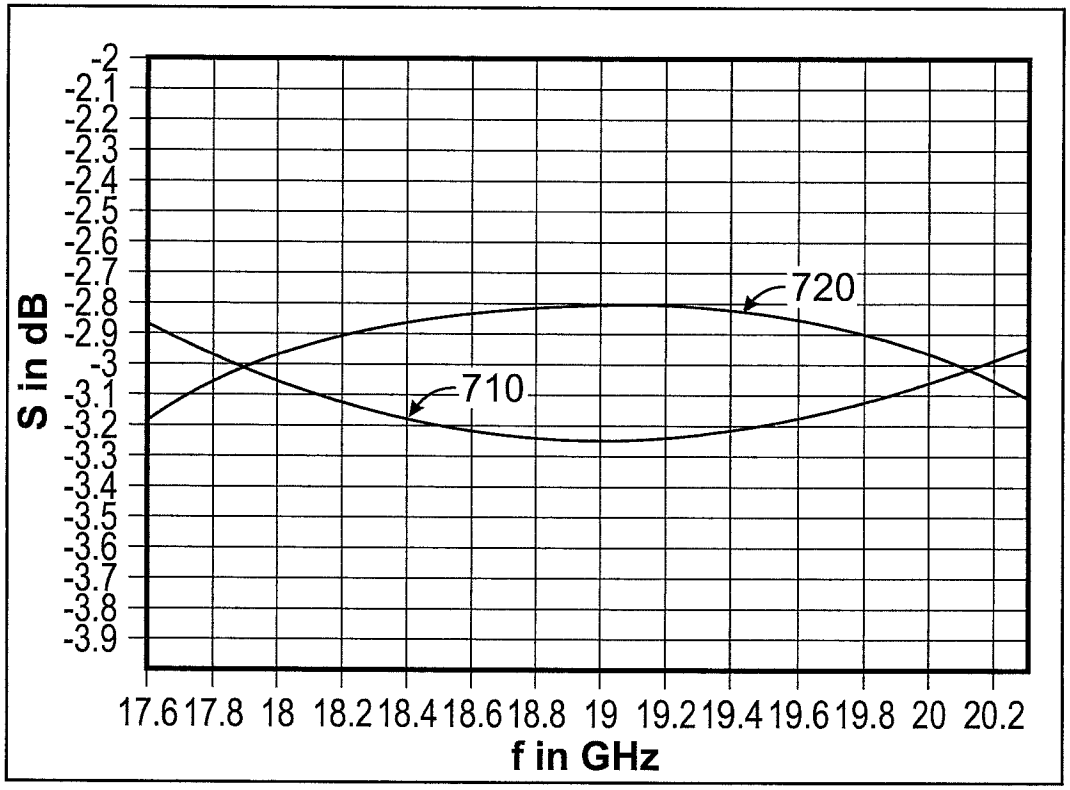
FIGS. 7A and 7B are a schematic diagram illustrating an air-cavity model of an example branch-line coupler of a broadband polarization waveguide network and a chart showing an example optimized performance of the branch-line coupler, according to certain aspects of the disclosure.
Figure 7A:
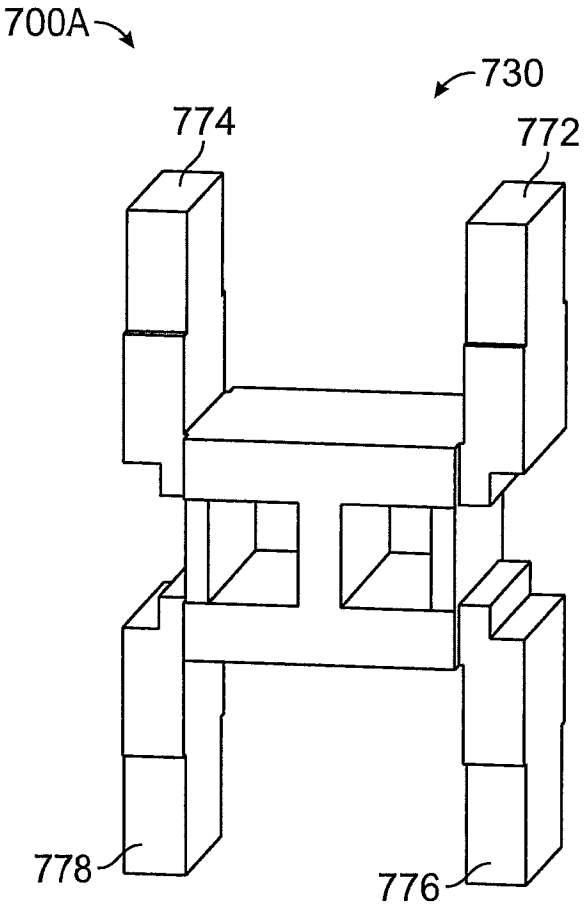

FIGS. 7A and 7B are a schematic diagram illustrating an air-cavity model 700A of an example branch-line coupler of a broadband polarization waveguide network and a chart 700B showing an example optimized performance of the branch-line coupler, according to certain aspects of the disclosure. The air-cavity model 700A of the branch-line coupler 730 has a similar structure as branch-line coupler 630 of FIG. 6D and is provided herein for reference. Ports 772, 774 and 776 are similar to ports 672, 674 and 676 of FIG. 6D. Port 778 can be coupled to a load (e.g., 650 of FIG. 6D).

Chart 700B depicts the optimized performance of the branch-line coupler 730 and includes plots 710 and 720 of power to ports 772 and 776. Polarizer 100, which utilizes two such branch-line couplers, achieves an axial ratio of 0.48 dB, which is similar to the best power split offered by an optimized same-size stand-alone branch coupler (e.g., 0.45 dB). Therefore, this proves no degradation in axial ratio due to the use of two branch-line couplers.

Figure 8B:
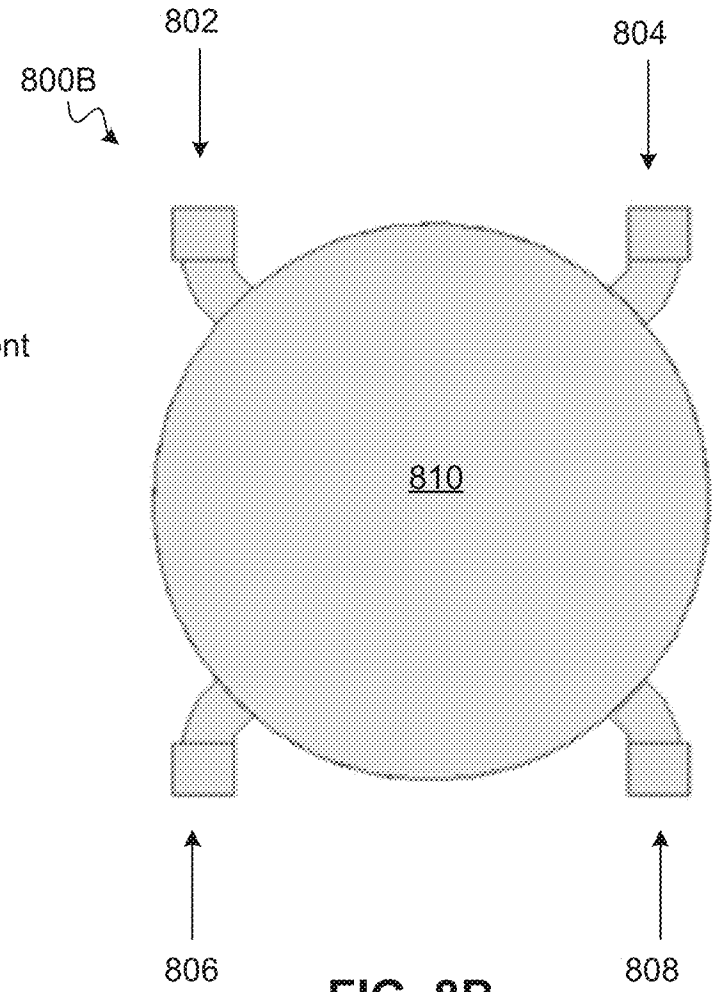
FIGS. 8A and 8B are schematic diagrams illustrating views of an air-cavity model of an example quadrature junction coupler (QJC) of a broadband polarization waveguide network, according to certain aspects of the disclosure.
Figure 8A:
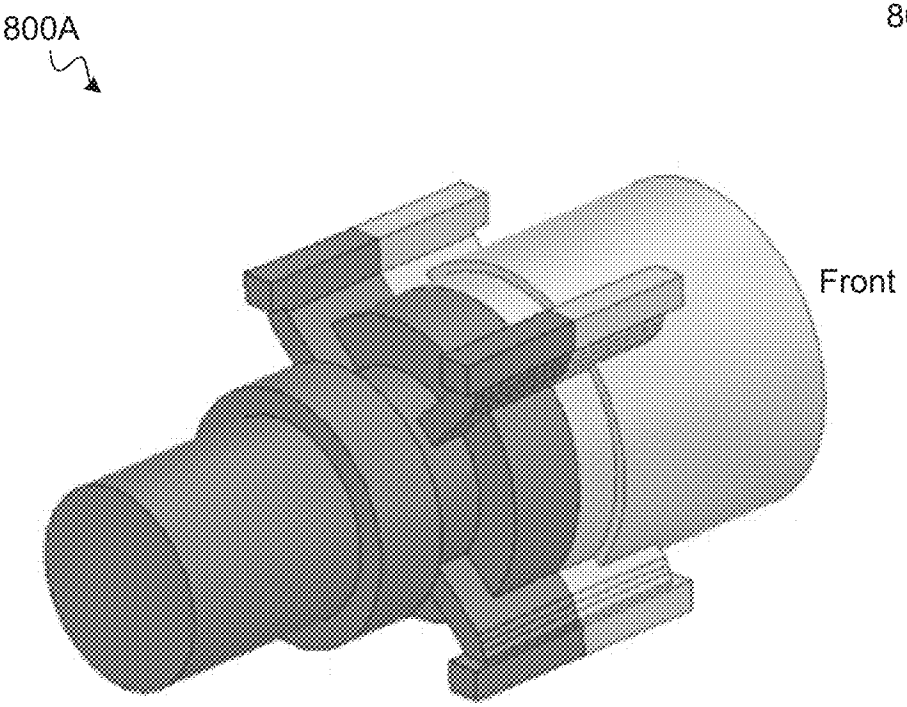

FIGS. 8A and 8B are schematic diagrams illustrating views of an air-cavity model 800A of an example QJC 810 of a broadband polarization waveguide network, according to certain aspects of the disclosure. FIG. 8A shows a perspective view of air-cavity model 800A of example QJC 810 (e.g., similar to 210 of FIG. 2B) with ports for coupling to four RX-reject waveguide filters.

FIG. 8B shows a front-view model 800B of the QJC, depicting ports 802, 804, 806 and 808. Ports 802 and 808 are zero-degree and 6-dB ports, and ports 804 and 806 are 90-degree and 6-dB ports. The power that is initially split to 3 dB at the reactive power splitter (e.g., 600A of FIG. 6A) and then to 6 dB (with a 90-degree phase shift) by the branch-line coupler (e.g., 630 of FIG. 6D) is recombined here at QJC 810. Due to the phase shift (90 degrees) generated herein, RHCP or LHCP can regain the full power initially presented to the splitter. The RHCP or LHCP is determined by the recombination path mating to the branch-line coupler.

Figure 9:
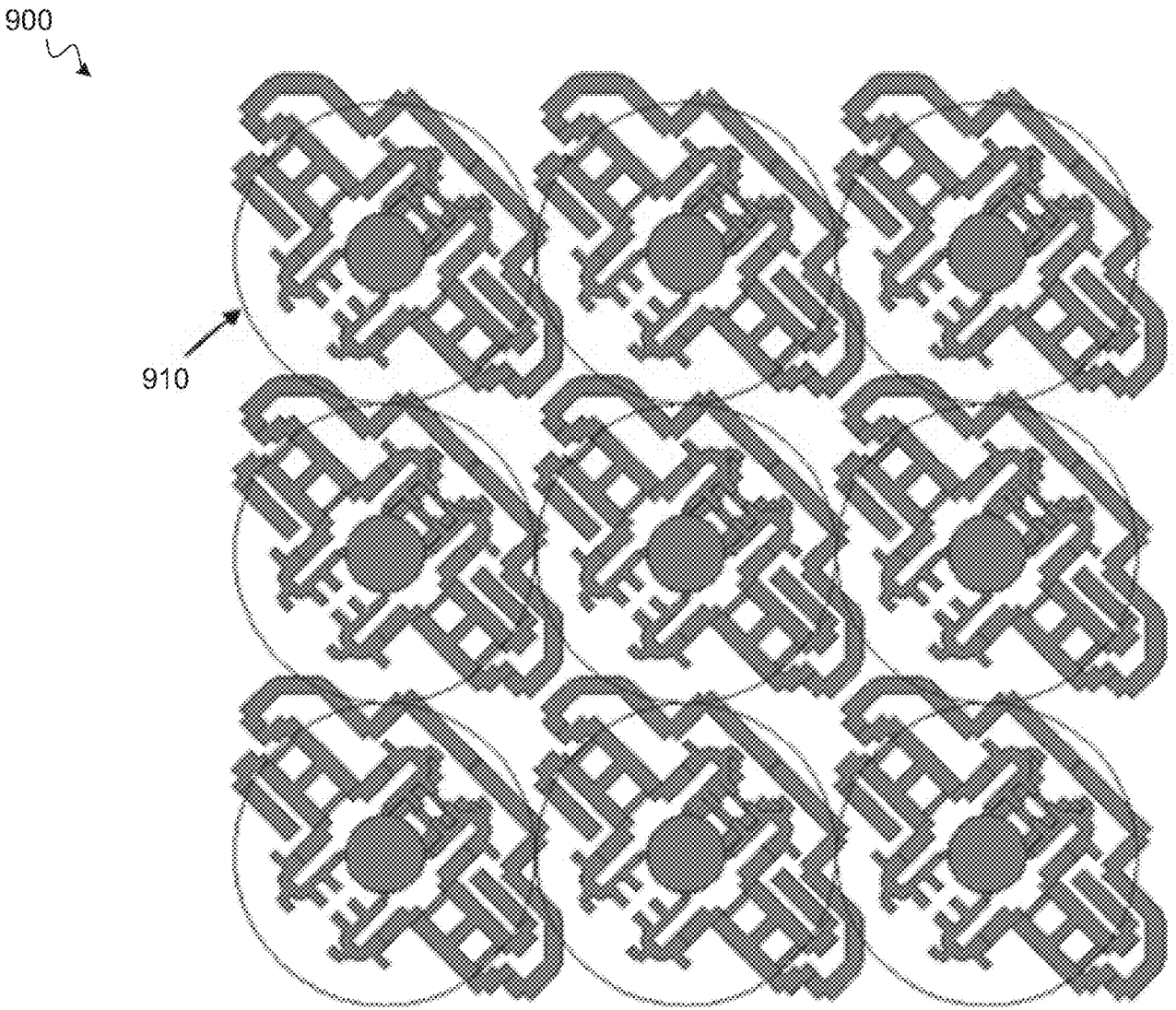
FIG. 9 is a schematic diagram illustrating an example array configuration of broadband polarization waveguide networks, according to certain aspects of the disclosure.

FIG. 9 is a schematic diagram illustrating an example array configuration 900 of broadband polarization waveguide networks, according to certain aspects of the disclosure. Array configuration 900 includes a number of broadband polarization waveguide network elements 910 arranged in multiple rows and columns. Broadband polarization waveguide network elements 910 are clocked 45 degrees such that they fit under the smallest Ka-band aperture size of about 1.7 inches. Array configuration 900 can be coupled to an antenna array, where each element of the antenna array (e.g., a horn antenna) is coupled to an antenna port of the broadband polarization waveguide network elements 910.

FIGS. 10A, 10B and 10C are charts 1000A and 1000B illustrating return-loss performance of an example broadband polarization waveguide network and a corresponding air-cavity model 1000C, according to certain aspects of the disclosure. Chart 1000A shows a plot 1010 of the variation of TX return loss at a TX port 3 of air-cavity model 1000C. The return-loss values, as depicted by plot 1010, are lower than −27 dB and well below a specification limit of about −18 dB, as shown by a line 1020.

Chart 1000B depicts plots 1030, 1040 and 1050. Plot 1030 shows variation of RHCP to LHCP isolation between RX ports 5 and 6 of air-cavity model 1000C. Plot 1040 shows variation of return loss at RX port 6 of air-cavity model 1000C, and Plot 1050 illustrates variation of return loss at RX port 5 of air-cavity model 1000C. The return-loss values, as depicted by plots 1030, 1040 and 1050, are lower than −25 dB, which is well below a specification limit of about −18 dB, as shown by a line 1060.

Figure 11A:
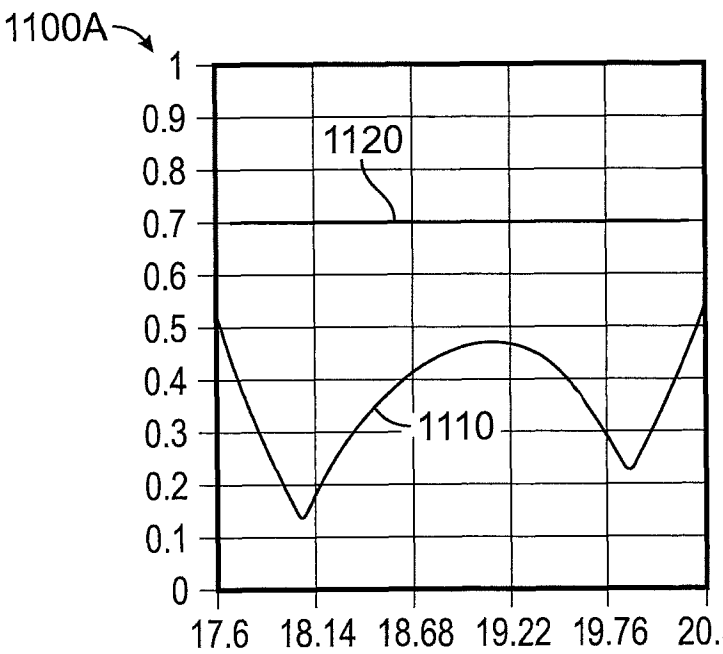
FIGS. 11A, 11B and 11C are charts illustrating axial-ratio performance of an example broadband polarization waveguide network and a corresponding air-cavity model, according to certain aspects of the disclosure.
Figure 11B:
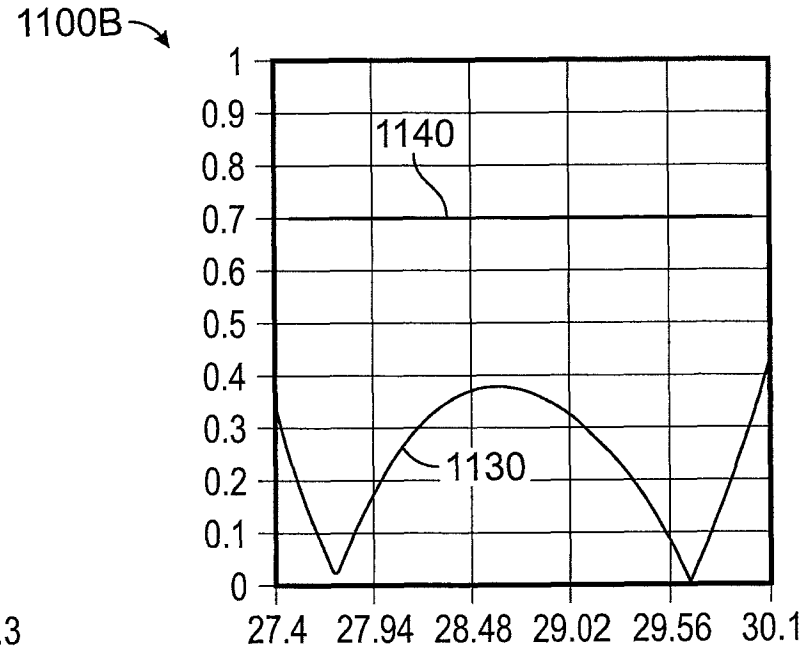
Figure 11C:
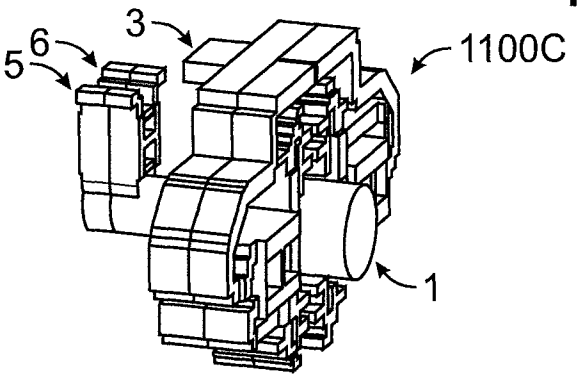

FIGS. 11A, 11B and 11C plus charts 1100A and 1100B illustrate axial-ratio performance of an example broadband polarization waveguide network and a corresponding air-cavity model 1100C, according to certain aspects of the disclosure. Chart 1100A shows a plot 1110 of the variation of TX axial ratio at a TX port 3 of air-cavity model 1100C. The TX axial ratio values, as depicted by plot 1110, are lower than about 0.48 dB and well below a specification limit of about 0.7 dB, as shown by a line 1120.

Chart 1100B depicts a plot 1130 that is RHCP and LHCP axial ratio of air-cavity model 1100C. The RX axial ratio values, as depicted by plot 1130 are lower than about 0.39 dB, which is well below a specification limit of about 0.7 dB, as shown by the line 1140.

Figure 12B:
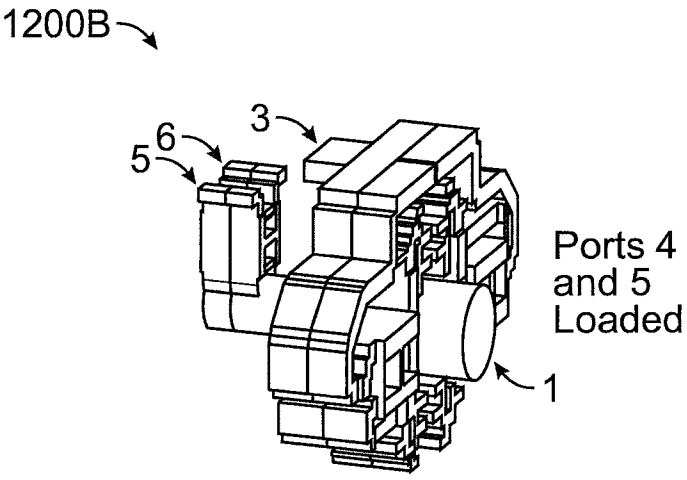
FIGS. 12A and 12B are a chart illustrating a mode-purity performance of an example broadband polarization waveguide network and a corresponding air-cavity model, according to certain aspects of the disclosure.
Figure 12A:
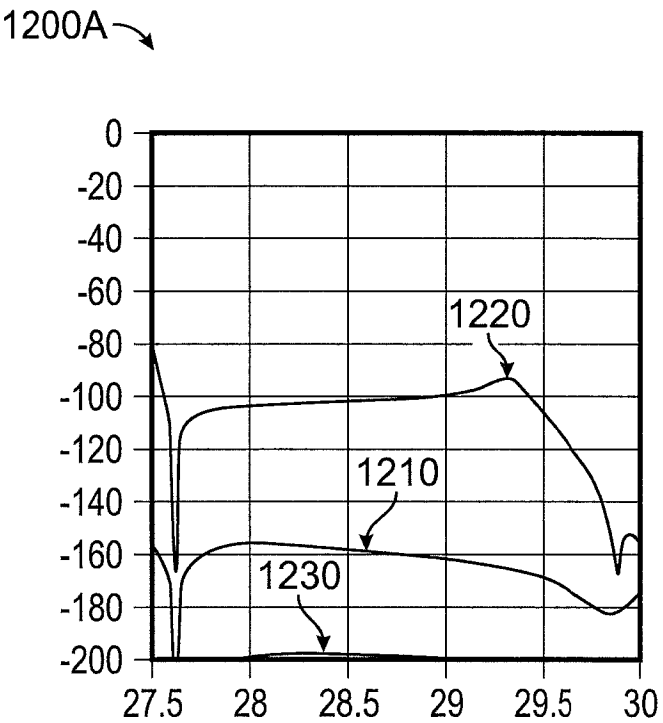

FIGS. 12A and 12B are a chart 1200A illustrating a mode-purity performance of an example broadband polarization waveguide network and a corresponding air-cavity model 1200B, according to certain aspects of the disclosure. Chart 1200A shows plots 1210, 1220 and 1230. Plot 1210 depicts the variation of mode purity of a TM01 mode at TX port 3 and antenna port 1 of air-cavity model 1200C. Plots 1220 and 1230 depict the variation of mode purity of a TE21 mode at TX port 3 and antenna port 1 of air-cavity model 1200C. It should be noted that ports 4 and 5 (of branch-line couplers 230 of FIG. 2B, not shown in FIG. 12B for simplicity) are coupled to impedance loads (e.g., 250 of FIG. 2B). The higher order modes in excess of 40 dB will degrade off-axis cross-polarization and axial-ratio performance. The higher order content is less than 75 dB.

FIGS. 13A, 13B and 13C are charts 1300A and 1300B illustrating TX-RX isolation performance of an example broadband polarization waveguide network and a corresponding air-cavity model 1300C, according to certain aspects of the disclosure. Chart 1300A shows plots 1310 and 1320 (overlapping plots) of the variation of RX-to-TX port isolation between RX ports 5 and 6 and a TX port 3 of air-cavity model 1300C. The RX-to-TX port isolation values, as depicted by plots 1310 and 1320, are lower than about −70 dB and well below a specification limit of about −55 dB, as shown by a line 1330.

Chart 1300B shows plots 1340 and 1350 (overlapping plots) of the variation of TX-to-RX port isolation between a TX port 3 and RX ports 5 and 6 of air-cavity model 1300C. The TX-to-RX isolation values, as depicted by plots 1340 and 1350, are lower than about −75 dB and well below a specification limit of about −55 dB, as shown by a line 1360.

Figure 14:
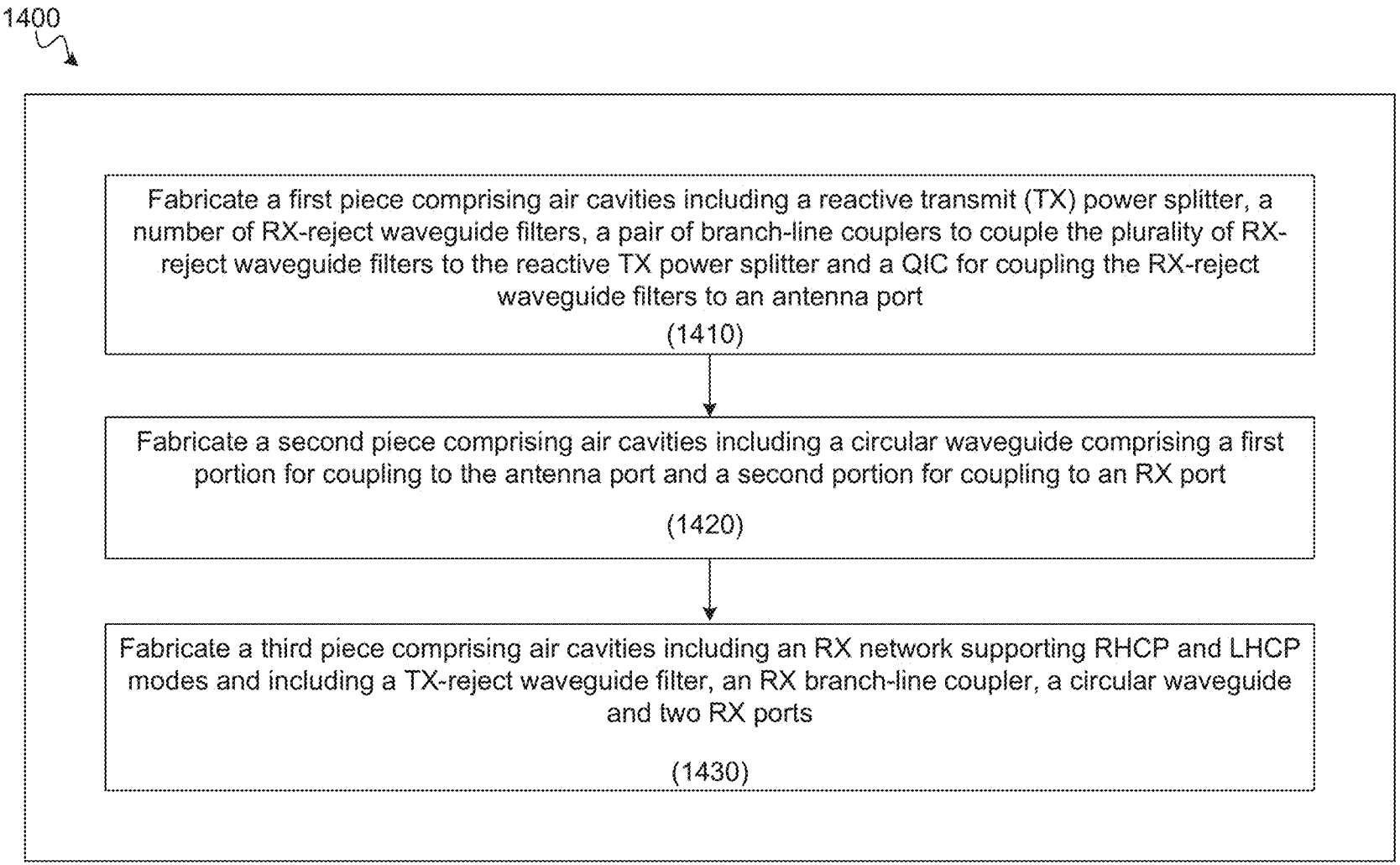
FIG. 14 is a flow diagram of a method of manufacturing a polarization waveguide network, according to certain aspects of the disclosure.

FIG. 14 is a flow diagram of a method 1400 of manufacturing a polarization waveguide network (e.g., 100 of FIG. 1, or 300A of FIG. 3A), according to certain aspects of the disclosure. Method 1400 includes fabricating a first piece (e.g., 202 of FIG. 2A) comprising air cavities including a reactive TX power splitter (e.g., 260 of FIGS. 2B and 2C), a number of RX-reject waveguide filters (e.g., 220 of FIGS. 2B and 2E), a pair of branch-line couplers (e.g., 230 of FIGS. 2B and 2D) to couple the plurality of RX-reject waveguide filters to the reactive TX power splitter and a QJC (e.g., 210 of FIG. 2B) for coupling the RX-reject waveguide filters to an antenna port (e.g., 306 of FIG. 3B) (1410). The method further includes fabricating a second piece (e.g., 304 of FIGS. 3A and 3D) comprising air cavities including a circular waveguide (e.g., 270 of FIG. 2F) comprising a first portion (e.g., 272 of FIG. 2F) for coupling to the antenna port and a second portion (e.g., 274 of FIG. 2F) for coupling to an RX port (e.g., 5 and 6 of FIG. 10C) (1420). The method further includes fabricating a third piece (e.g., 306 of FIG. 3C) comprising air cavities including an RX network supporting RHCP and LHCP modes and including a TX-reject waveguide filter, an RX branch-line coupler, a circular waveguide and two RX ports (e.g., 5 and 6 of FIG. 10C) (1430).

In some aspects, the subject technology is related to antenna technology, and more particularly to a broadband single polarization TX, dual polarization RX, circular polarization waveguide network. In some aspects, the subject technology may be used in various markets, including, for example and without limitation, sensor technology, communication systems and radar technology markets.

Those of skill in the art would appreciate that the various illustrative blocks, modules, elements, components, methods, and algorithms described herein may be implemented as electronic hardware, computer software, or combinations of both. To illustrate this interchangeability of hardware and software, various illustrative blocks, modules, elements, components, methods, and algorithms have been described above generally in terms of their functionalities. Whether such functionalities are implemented as hardware or software depends upon the particular application and design constraints imposed on the overall system. Skilled artisans may implement the described functionalities in varying ways for each particular application. Various components and blocks may be arranged differently (e.g., arranged in a different order, or partitioned in a different way), all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks may be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single hardware and software product or packaged into multiple hardware and software products.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined, or modified and all such variations are considered within the scope and spirit of the present invention. While compositions and methods are described in terms of "comprising," "containing," or "including" various components or steps, the compositions and methods can also "consist essentially of" or "consist of" the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meanings unless otherwise explicitly and clearly defined by the patentee. If there is any conflict in the usage of a word or term in this specification and one or more patent or other documents that may be incorporated herein by reference, the definition that is consistent with this specification should be adopted.

What is claimed is:

1. A polarization waveguide network comprising:

a reactive transmit (TX) power splitter;

a plurality of receive (RX)-reject waveguide filters configured to reject RX frequencies;

a pair of branch-line couplers configured to couple the plurality of RX-reject waveguide filters to the reactive TX power splitter;

a quadrature junction coupler configured to couple the plurality of RX-reject waveguide filters to an antenna port, wherein:

the polarization waveguide network is configured to be fabricated in three pieces with two zero-current split planes, and a first piece of the three pieces is configured to be coupled to the antenna port.

2. The polarization waveguide network of claim 1, further comprising a pair of TX recombination-path waveguides configured to couple the pair of branch-line couplers to the reactive TX power splitter.

3. The polarization waveguide network of claim 2, wherein the pair of TX recombination-path waveguides are substantially identical in phase length and structurally mirror images of each other expect near the branch-line couplers where the bends are clocked differently.

4. The polarization waveguide network of claim 3, wherein an unused and isolated port of the branch-line coupler is terminated into a load, wherein the load is configured to absorb any manufacturing path length mismatch in the pair of TX recombination-path waveguides and to mitigate manufacturing risks.

5. The polarization waveguide network of claim 1, wherein the plurality of RX-reject waveguide filters comprises four RX-reject waveguide filters each comprising a single-sided corrugated low-pass waveguide filter comprising at least two teeth.

6. The polarization waveguide network of claim 1, further comprising transition waveguides coupling the pair of branch-line couplers to the plurality of RX-reject waveguide filters.

7. The polarization waveguide network of claim 1, wherein each branch-line coupler of the pair of branch-line couplers is configured to achieve an axial ratio better than about 0.5 dB over a 13% TX bandwidth.

8. The polarization waveguide network of claim 1, wherein a second piece of the three pieces comprises a circular waveguide comprising a first portion and a second portion, wherein the first portion has a larger radius than the second portion.

9. The polarization waveguide network of claim 8, wherein the first portion is coupled to the antenna port and is configured to support both TX and RX modes of propagation, and wherein the second portion is coupled to an RX port and is configured to support the RX mode of propagation and to reject TX frequencies.

10. The polarization waveguide network of claim 8, wherein the TX mode of propagation supports right-handed circular polarization (RHCP) or left-handed circular polarization (LHCP).

11. The polarization waveguide network of claim 1, further comprising a TX port implemented in a second piece of the three pieces, and wherein the TX port is configured to achieve a return loss better than about 27 dB and a TX-axial ratio better than about 0.5 dB.

12. The polarization waveguide network of claim 11, wherein the TX port is configured to achieve an isolation with an RX port of better than about 70 dB.

13. The polarization waveguide network of claim 11, wherein a third piece of the three pieces comprises an RX network comprising a TX-reject waveguide filter, an RX branch-line coupler, a circular waveguide and two RX ports, and wherein the RX network is configured to support RHCP and LHCP modes.

14. The polarization waveguide network of claim 13, wherein the RX branch-line coupler is directly coupled to the circular waveguide utilizing 45-degree bend waveguides.

15. The polarization waveguide network of claim 14, wherein a cross-section at a split plane between the first piece and the second piece includes the reactive TX power splitter, the pair of TX recombination-path waveguides, the plurality of RX-reject waveguide filters, the pair of RX branch-line couplers, the quadrature junction coupler and the antenna port.

16. The polarization waveguide network of claim 15, wherein a cross-section at a split plane between the second piece and the third piece includes the TX-reject waveguide filter, the RX branch-line coupler, the circular waveguide, two RX ports and the 45-degree bend waveguides.

17. An antenna array system comprising:

an antenna array including a plurality of antenna elements;

a polarization array including a plurality of polarization waveguide networks, each coupled to an antenna element of the antenna array and comprising:

a reactive transmit (TX) power splitter;

a plurality of receive (RX)-reject waveguide filters configured to reject RX frequencies;

a pair of branch-line couplers configured to couple the plurality of RX-reject waveguide filters to the reactive TX power splitter;

a pair of TX recombination-path waveguides configured to couple the pair of branch-line couplers to the reactive TX power splitter; and a quadrature junction coupler configured to couple the plurality of RX-reject waveguide filters to an antenna port of the antenna element of the antenna array, wherein each waveguide network of the polarization array is configured to be fabricated in three pieces with two zero-current split planes, and a first piece of the three pieces is configured to be coupled to the antenna port.

18. The antenna array system of claim 17, wherein:

a second piece of the three pieces comprises a circular waveguide comprising a first portion and a second portion, the first portion has a larger radius than the second portion, and the first portion is coupled to the antenna port and is configured to support both TX and RX modes of propagation, the second portion is coupled to an RX port and is configured to support the RX mode of propagation and to reject TX frequencies, a third piece of three pieces comprises an RX network comprising a TX-reject waveguide filter, an RX branch-line coupler, a circular waveguide and two RX ports, and the RX network is configured to support right-handed circular polarization (RHCP) and left-handed circular polarization (LHCP) modes.

19. A method of manufacturing a polarization waveguide network, the method comprising:

fabricating a first piece comprising air cavities including a reactive transmit (TX) power splitter, a plurality of receive (RX)-reject waveguide filters, a pair of branch-line couplers configured to couple the plurality of RX-reject waveguide filters to the reactive TX power splitter and a quadrature junction coupler for coupling the plurality of RX-reject waveguide filters to an antenna port;

fabricating a second piece comprising air cavities including a circular waveguide comprising a first portion for coupling to the antenna port and a second portion for coupling to an RX port; and fabricating a third piece comprising air cavities including an RX network supporting RHCP and LHCP modes and including a TX-reject waveguide filter, an RX branch-line coupler, a circular waveguide and two RX ports.

20. The method of claim 19, wherein fabricating the first piece, the second piece and the third piece are performed using at least one of machining, electroplating or three-dimensional (3-D) printing, and wherein the first piece, the second piece and the third piece have two zero-current split planes.

* * * * *